US012637192B2

(12) United States Patent
Ooshita

(10) Patent No.: US 12,637,192 B2
(45) Date of Patent: May 26, 2026

(54) WATERCRAFT, WATERCRAFT CONTROL DEVICE, WATERCRAFT CONTROL METHOD, AND PROGRAM

(71) Applicant: NHK SPRING Co., Ltd., Yokohama (JP)

(72) Inventor: Sachio Ooshita, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 615 days.

(21) Appl. No.: 18/008,489

(22) PCT Filed: Jun. 8, 2021

(86) PCT No.: PCT/JP2021/021745
§ 371 (c)(1),
(2) Date: Dec. 6, 2022

(87) PCT Pub. No.: WO2021/251382
PCT Pub. Date: Dec. 16, 2021

(65) Prior Publication Data

US 2023/0339589 A1 Oct. 26, 2023

(30) Foreign Application Priority Data

Jun. 10, 2020 (JP) ..... 2020-101112

(51) Int. Cl.
*B63H 25/20* (2006.01)
*B63B 79/40* (2020.01)
(Continued)

(52) U.S. Cl.
CPC ..... *B63H 25/20* (2013.01); *B63B 79/40* (2020.01); *B63C 9/0005* (2013.01); *B63H 25/04* (2013.01)

(58) Field of Classification Search
CPC ..... B63B 79/40; B63C 9/0005; B63H 25/04; B63H 25/02; B63H 25/08; B63H 25/10;
(Continued)

(56) References Cited

U.S. PATENT DOCUMENTS 3,138,133 A 6/1964 Hatch
4,630,205 A 12/1986 Otaka
(Continued)

FOREIGN PATENT DOCUMENTS

JP 2020019424 A 2/2020
KR 1020010069812 A 7/2001
KR 101720713 B1 3/2017

OTHER PUBLICATIONS

Endo Akira et. al., "Maneuvering and steering system, Battle of Solomon Sea: The death battle in the Guadalcanal area", 1st printing, Sankei Shuppan KK, Aug. 10, 1983, pp. 122-147, ISBN 4-383-02263-4; 15 pages.
(Continued)

*Primary Examiner* — Andrew Polay
(74) *Attorney, Agent, or Firm* — CANTOR COLBURN LLP

(57) ABSTRACT

A watercraft includes a steering unit, a rudder unit, a transmission unit configured to connect the steering unit and the rudder unit and mechanically transmit an input operation on the steering unit to the rudder unit, a drive unit configured to operate the rudder unit without any need of an input operation on the steering unit, and a watercraft control device for controlling the drive unit.

18 Claims, 8 Drawing Sheets

(51) Int. Cl.
*B63C 9/00* (2006.01)
*B63H 25/04* (2006.01)

(58) Field of Classification Search
CPC ..... B63H 25/14; B63H 25/16; B63H 25/18; B63H 25/20; B63H 25/24; B63H 25/26
See application file for complete search history.

(56) References Cited

U.S. PATENT DOCUMENTS

| | | | | |
|---|---|---|---|---|
| 4,941,854 | A | 7/1990 | Takahashi et al. | |
| 2003/0089291 | A1* | 5/2003 | Kanno | B63C 11/26 114/144 A |
| 2010/0120303 | A1* | 5/2010 | Murai | B63H 20/28 440/59 |
| 2018/0335780 | A1 | 11/2018 | Stevens et al. | |

OTHER PUBLICATIONS

International Search Report for International Application No. PCT/JP2021/021745; Date of Mailing, Aug. 24, 2021.
Yamaguchi Masuto, "Ship discussion (No. 6)"; Senpaku, vol. 14, No. 7, Ten Nen Sha Inc., Jul. 1, 1941, pp. 501-510.
Yasui Ichiro, On the shallow draught oil tanker 'Sant Ana', Journal of Zosen Kiokai, 1956, No. 90, pp. 177-188.
EPO Extended European Search Report for corresponding EP Application No. 21821785.9; Mailing Date, Nov. 3, 2023.

* cited by examiner

WATERCRAFT, WATERCRAFT CONTROL DEVICE, WATERCRAFT CONTROL METHOD, AND PROGRAM

CROSS REFERENCE TO RELATED APPLICATIONS

This is the U.S. national stage of application No. PCT/JP2021/021745, filed on Jun. 8, 2021. Priority under 35 U.S.C. § 119(a) and 35 U.S.C. § 365(b) is claimed from Japanese Application No. 2020-101112, filed Jun. 10, 2020, the disclosure of which is also incorporated herein by reference.

TECHNICAL FIELD

The present invention relates to a watercraft, a watercraft control device, a watercraft control method, and a program.

BACKGROUND ART

In the related art, a personal watercraft (PWC) auto-return system is known (see, for example, Patent Document 1). The PWC auto-return system described in Patent Document 1 includes a user device and an autopilot unit arranged within a PWC. The user device includes a rider location determination unit, a user interface, and a communication unit. In the technology described in Patent Document 1, when a rider carrying the user device is away from the PWC (falls overboard), the PWC receives a request from the user interface and moves to a location of the user device in an automatic maneuvering process.

Meanwhile, a specific configuration for implementing the automatic maneuvering process of the PWC is not described in Patent Document 1. Thus, according to the technology described in Patent Document 1, it may be difficult to appropriately implement the automatic maneuvering process of automatically returning the PWC to the rider at a location away from the PWC.

CITATION LIST

Patent Document

Patent Document 1
United States Patent Application, Publication No. 2018/0335780
Patent Document 2
Japanese Unexamined Patent Application, First Publication No. 2020-019424

SUMMARY OF INVENTION

Technical Problem

In view of the above-described problem, an objective of the present invention is to provide a watercraft, a watercraft control device, a watercraft control method, and a program capable of appropriately implementing a manual maneuvering mode and an automatic maneuvering mode of a watercraft.

Solution to Problem

According to an aspect of the present invention, there is provided a watercraft including: a steering unit; a rudder unit; a transmission unit configured to connect the steering unit and the rudder unit and mechanically transmit an input operation on the steering unit to the rudder unit; a drive unit configured to operate the rudder unit without any need for an input operation on the steering unit; and a watercraft control device configured to control the drive unit.

According to an aspect of the present invention, there is provided a watercraft control device provided in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit, wherein a process of controlling the drive unit and a process of controlling the electromagnetic clutch are executed.

According to an aspect of the present invention, there is provided a watercraft control method for use in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit, the watercraft control method including: a drive unit control step of controlling the drive unit; and an electromagnetic clutch control step of controlling the electromagnetic clutch.

According to an aspect of the present invention, there is provided a program for causing a computer provided in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit to execute: a drive unit control step of controlling the drive unit; and an electromagnetic clutch control step of controlling the electromagnetic clutch.

Advantageous Effects of Invention

According to the present invention, it is possible to provide a watercraft, a watercraft control device, a watercraft control method, and a program capable of appropriately implementing a manual maneuvering mode and an automatic maneuvering mode of a watercraft.

DESCRIPTION OF EMBODIMENTS

First Embodiment

A first embodiment of a watercraft, a watercraft control device, a watercraft control method, and a program according to the present invention will be described below.

Figure 1:
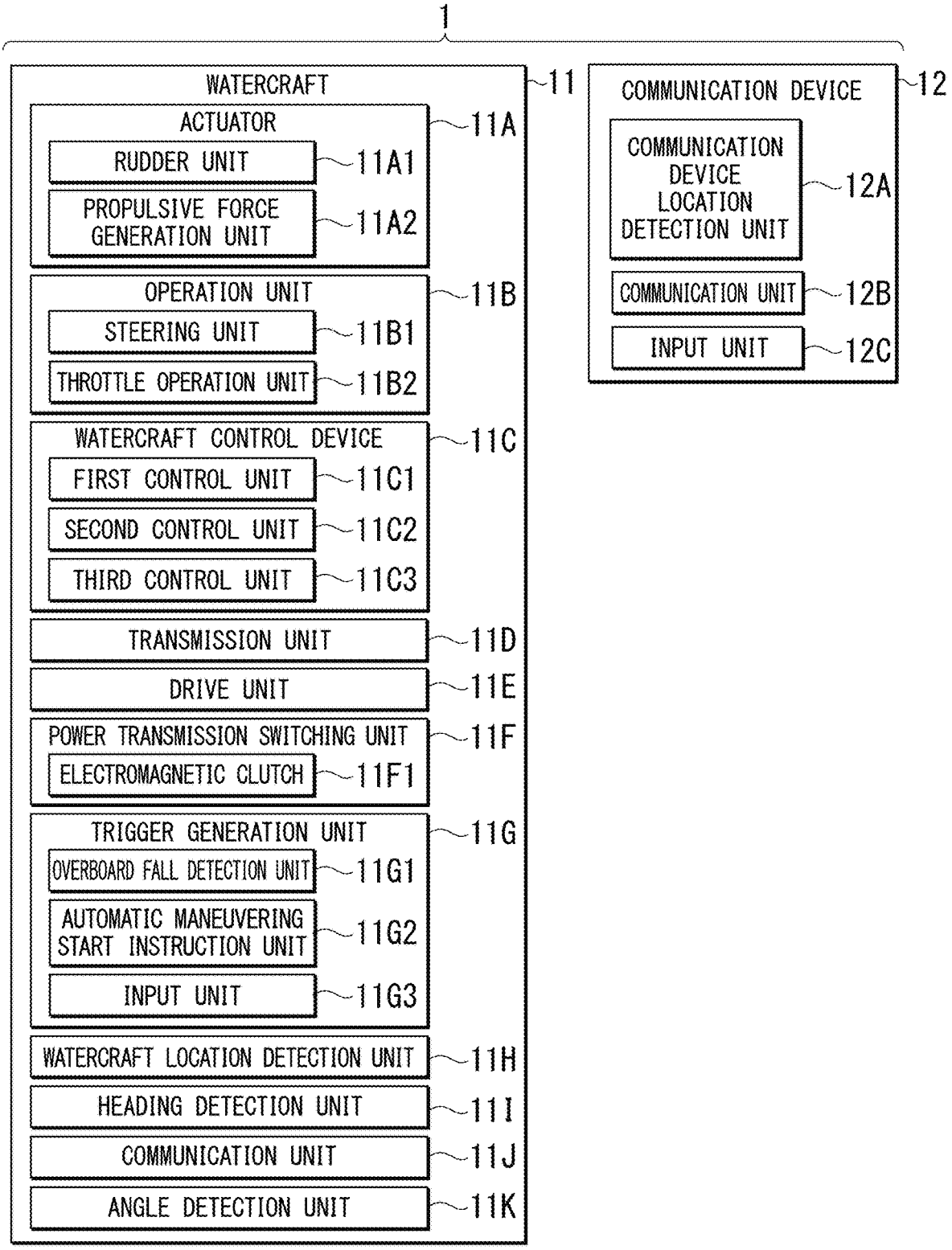
FIG. 1 is a diagram schematically showing an example of an automatic maneuvering system to which a watercraft of a first embodiment is applied.
Figure 2:
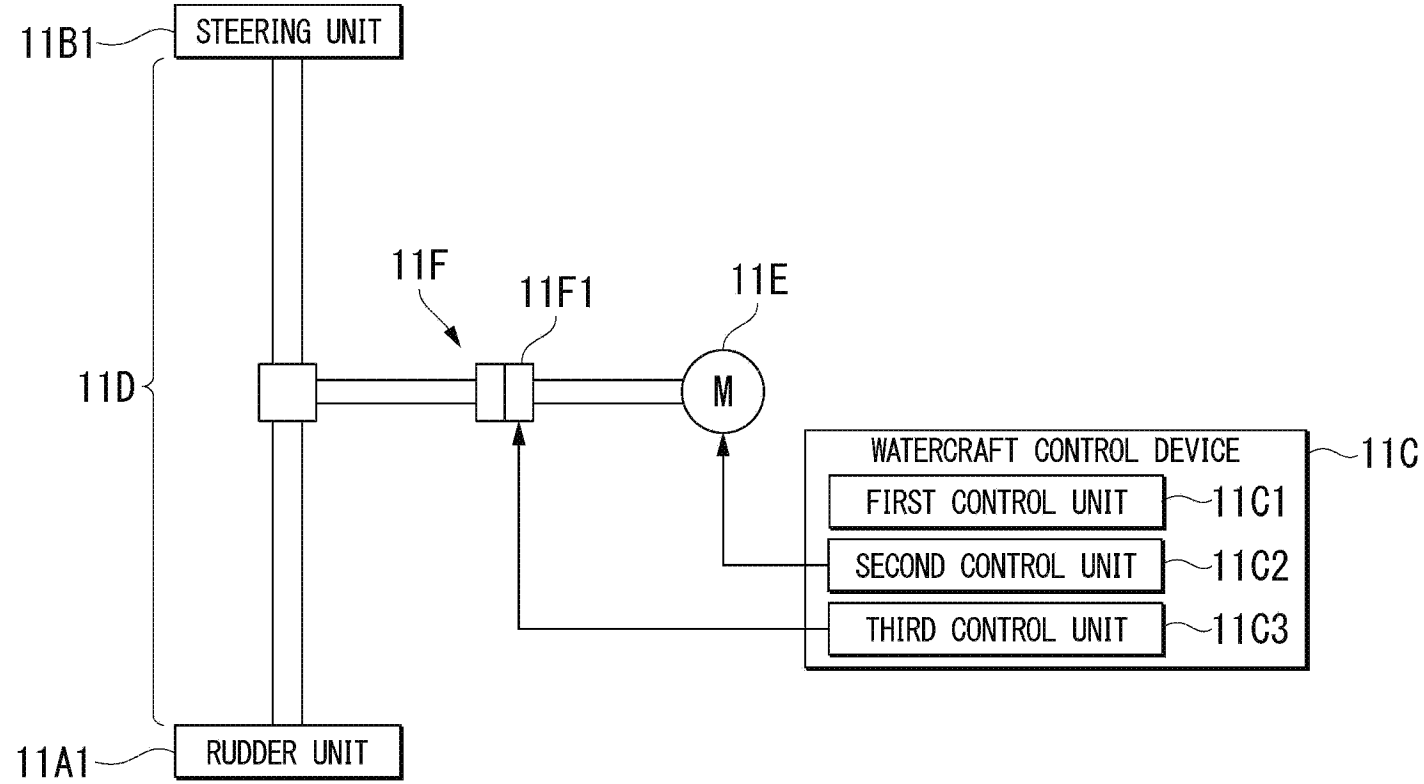
FIG. 2 is a diagram showing an example of a schematic configuration of a steering system from a steering unit to a rudder unit of the watercraft shown in FIG. 1.

FIG. 1 is a diagram schematically showing an example of an automatic maneuvering system 1 to which a watercraft 11 of the first embodiment is applied. FIG. 2 is a diagram showing an example of a schematic configuration of a steering system from a steering unit 11B1 to a rudder unit 11A1 of the watercraft 11 shown in FIG. 1.

In the examples shown in FIG. 1 and FIG. 2, the automatic maneuvering system 1 includes the watercraft 11 and a communication device 12.

The watercraft 11 of the first embodiment is, for example, a personal watercraft (PWC) (a water-motorcycle) having functions similar to those of the PWC described in FIG. 1 of Japanese Patent No. 5196649. The watercraft 11 includes an actuator 11A, an operation unit 11B, a watercraft control device 11C, a transmission unit 11D, a drive unit 11E, a power transmission switching unit 11F, a trigger generation unit 11G, a watercraft location detection unit 11H, a heading detection unit 11I, a communication unit 11J, and an angle detection unit 11K.

The actuator 11A includes the rudder unit 11A1 and a propulsive force generation unit 11A2. The rudder unit 11A1 has a function of generating a turning moment in the watercraft 11. The propulsive force generation unit 11A2 has a function of generating a propulsive force for the watercraft 11. The actuator 11A includes, for example, the engine, the nozzle, the deflector, the trim actuator, the bucket, the bucket actuator, and the like described in FIG. 1 of Japanese Unexamined Patent Application, First Publication No. 2019-171925.

The operation unit 11B includes a steering unit 11B1 and a throttle operation unit 11B2. The steering unit 11B1 receives an input operation by a watercraft operator who operates the rudder unit 11A1. The throttle operation unit 11B2 receives an input operation by the watercraft operator who operates the propulsive force generation unit 11A2. The operation unit 11B is configured like, for example, the steering handle device described in FIG. 1 of Japanese Patent No. 5196649, the steering unit described in FIG. 1 of Japanese Unexamined Patent Application, First Publication No. 2019-171925, or the like.

The watercraft control device 11C performs a control process of operating the actuator 11A on the basis of the watercraft operator's input operation received by the operation unit 11B and the like. The watercraft control device 11C has a manual maneuvering mode in which the actuator 11A is operated on the basis of an input operation on the operation unit 11B and an automatic maneuvering mode in which the actuator 11A is operated without any need for an input operation on the operation unit 11B.

The watercraft control device 11C includes a first control unit 11C1, a second control unit 11C2, and a third control unit 11C3.

The first control unit 11C1 controls the propulsive force generation unit 11A2. In detail, during the manual maneuvering mode, the first control unit 11C1 performs a control process of operating the propulsive force generation unit 11A2 on the basis of the watercraft operator's input operation received by the throttle operation unit 11B2. In the automatic maneuvering mode, the first control unit 11C1 performs a control process of operating the propulsive force generation unit 11A2 on the basis of relative locations of the watercraft 11 and the communication device 12 and heading.

The second control unit 11C2 controls the drive unit 11E. In detail, during the manual maneuvering mode, the second control unit 11C2 does not operate the drive unit 11E. On the other hand, during the automatic maneuvering mode, the second control unit 11C2 performs a control process of operating the drive unit 11E on the basis of the relative locations of the watercraft 11 and the communication device 12 and the heading.

The third control unit 11C3 controls the electromagnetic clutch 11F1, which will be described below. In detail, during the manual maneuvering mode, the third control unit 11C3 does not operate the electromagnetic clutch 11F1 (turns off the electromagnetic clutch 11F1). On the other hand, during the automatic maneuvering mode, the third control unit 11C3 operates the electromagnetic clutch 11F1 (turns on the electromagnetic clutch 11F1).

The transmission unit 11D has, for example, a mechanical cable that connects the steering unit 11B1 and the rudder unit 11A1. The transmission unit 11D mechanically transmits an input operation on the steering unit 11B1 to the rudder unit 11A1.

The drive unit 11E has, for example, a motor or the like, and operates the rudder unit 11A1 during the automatic maneuvering mode. In detail, during the automatic maneuvering mode, the drive unit 11E operates the rudder unit 11A1 without any need for an input operation on the steering unit 11B1. On the other hand, during the manual maneuvering mode, the drive unit 11E does not operate the rudder unit 11A1.

The power transmission switching unit 11F switches the power transmission from the drive unit 11E to the rudder unit 11A1 between the time of the manual maneuvering mode and the time of the automatic maneuvering mode. The power transmission switching unit 11F is provided between the transmission unit 11D and the drive unit 11E. The power transmission switching unit 11F functions as a part of a connection mechanism that connects the drive unit 11E and the rudder unit 11A1. The power transmission switching unit 11F has the electromagnetic clutch 11F1. That is, the connection mechanism has the electromagnetic clutch 11F1.

As described above, the electromagnetic clutch 11F1 is not operated (or is turned off) by the third control unit 11C3 during the manual maneuvering mode and the electromagnetic clutch 11F1 is operated (or is turned on) by the third control unit 11C3 during the automatic maneuvering mode.

Specifically, because a current-carrying process for the electromagnetic clutch 11F1 is not performed during the manual maneuvering mode, the electromagnetic clutch 11F1 does not connect the drive unit 11E and the transmission unit and does not perform power transmission between the drive unit 11E and the rudder unit 11A1. Also, during the manual maneuvering mode, the drive unit 11E is not operated (for example, a current-carrying process for the motor is not performed). In other words, because the electromagnetic clutch 11F1 does not perform power transmission between the drive unit 11E and the rudder unit 11A1 during the manual maneuvering mode, the drive unit 11E does not act as resistance (for example, the stopped motor does not act as resistance), an angle of the rudder unit 11A1 (a rudder angle) can be changed in accordance with the input operation on the steering unit 11B1.

On the other hand, during the automatic maneuvering mode, a current-carrying process for the electromagnetic clutch 11F1 is performed and the electromagnetic clutch 11F1 connects the drive unit 11E and the transmission unit and performs power transmission between the drive unit 11E and the rudder unit 11A1. Also, during the automatic maneuvering mode, the drive unit 11E is operated on the basis of the relative locations of the watercraft 11 and the communication device 12 and the heading (for example, the current-carrying process for the motor is performed). That is, during the automatic maneuvering mode, the electromagnetic clutch 11F1 performs power transmission from the drive unit 11E to the rudder unit 11A1 and the angle of the rudder unit 11A1 (the rudder angle) can be changed according to power.

In detail, when the automatic maneuvering mode starts, the electromagnetic clutch 11F1 connects the drive unit 11E and the rudder unit 11A1 by performing a current-carrying process for the electromagnetic clutch 11F1. Subsequently, while the electromagnetic clutch 11F1 connects the drive unit 11E and the rudder unit 11A1, the drive unit 11E operates the rudder unit 11A1.

As described above, in the examples shown in FIG. 1 and FIG. 2, because the drive unit 11E does not operate the rudder unit 11A1 during the manual maneuvering mode, a size of the drive unit 11E can be reduced.

The trigger generation unit 11G generates a trigger for switching the mode of the watercraft control device 11C from the manual maneuvering mode to the automatic maneuvering mode. The trigger generation unit 11G includes an overboard fall detection unit 11G1, an automatic maneuvering start instruction unit 11G2, and an input unit 11G3.

The overboard fall detection unit 11G1 detects the falling of an occupant of the watercraft 11 (for example, a watercraft operator, an occupant other than the watercraft operator, or the like) overboard. The overboard fall detection unit 11G1 of the first embodiment is configured like, for example, the lanyard cord and the switch described in paragraph 0002 of Japanese Patent No. 4205261. Specifically, one end of the lanyard cord is connected to an overboard fall detection target person (for example, the watercraft operator, the occupant other than the watercraft operator, or the like). The other end of the lanyard cord is connected to a switch (not shown) arranged within the watercraft 11.

When the detection target person falls overboard from the watercraft 11, the other end of the lanyard cord is disconnected from the switch and the switch detects the falling of the detection target person overboard. As a result, the trigger generation unit 11G generates a trigger and the watercraft control device 11C switches the mode from the manual maneuvering mode to the automatic maneuvering mode.

The automatic maneuvering start instruction unit 11G2 outputs an automatic maneuvering start instruction on the basis of an automatic maneuvering start request transmitted from the communication device 12 (the "automatic maneuvering start request" will be described below).

When the automatic maneuvering start instruction unit 11G2 outputs the automatic maneuvering start instruction, the watercraft control device 11C starts a control (automatic maneuvering mode control) process of operating the actuator 11A without any need for the operation unit 11B to receive an input operation. The watercraft control device 11C controls the actuator 11A on the basis of relative locations of the watercraft 11 and the communication device 12 and heading in the automatic maneuvering mode.

In other words, in the examples shown in FIG. 1 and FIG. 2, when the overboard fall detection unit 11G1 does not detect the falling of the occupant of the watercraft 11 overboard (during the manual maneuvering mode), the electromagnetic clutch 11F1 does not connect the transmission unit 11D and the drive unit 11E. On the other hand, when the overboard fall detection unit 11G1 has detected the falling of the occupant of the watercraft 11 overboard (during the automatic maneuvering mode), the electromagnetic clutch 11F1 connects the transmission unit 11D and the drive unit 11E.

In another example, the trigger generation unit 11G may not include the automatic maneuvering start instruction unit 11G2. In the present example, when the overboard fall detection unit 11G1 detects the falling of an occupant of the watercraft 11 overboard, the trigger generation unit 11G generates a trigger, and the watercraft control device 11C switches the mode from the manual maneuvering mode to the automatic maneuvering mode, and also starts the control of the automatic maneuvering mode.

In the examples shown in FIG. 1 and FIG. 2, the input unit 11G3 receives, for example, the automatic maneuvering start request from the watercraft operator of the watercraft 11 (for example, the automatic maneuvering start request from the watercraft operator who is about to disembark from the watercraft 11 while carrying the communication device 12).

The automatic maneuvering start instruction unit 11G2 also outputs an automatic maneuvering start instruction when the input unit 11G3 receives the automatic maneuvering start request. When the automatic maneuvering start instruction unit 11G2 outputs the automatic maneuvering start instruction, the watercraft control device 11C starts a control process of operating the actuator 11A (a process of controlling the automatic maneuvering mode) without any need for the operation unit 11B to receive an input operation. In the automatic maneuvering mode, the watercraft control device 11C controls the actuator 11A on the basis of relative locations of the watercraft 11 and the communication device 12 (in detail, the communication device 12 carried by the watercraft operator who has disembarked from the watercraft 11) and heading of the watercraft 11.

In another example, the trigger generation unit 11G may not include the input unit 11G3.

In the examples shown in FIG. 1 and FIG. 2, the watercraft location detection unit 11H detects a location of the watercraft 11. The watercraft location detection unit 11H includes, for example, a Global Positioning System (GPS) device. The GPS device calculates location coordinates of the watercraft 11 by receiving signals from a plurality of GPS satellites. The location of the watercraft 11 detected by the watercraft location detection unit 11H is used for controlling the automatic maneuvering mode of the watercraft control device 11C described above.

The heading detection unit 11I detects the heading of the watercraft 11. The heading detection unit 11I includes, for example, a direction sensor. The direction sensor calculates the heading of the watercraft 11 using, for example, geomagnetism. The heading of the watercraft 11 detected by the heading detection unit 11I is used for controlling the automatic maneuvering mode of the watercraft control device 11C.

In another example, the direction sensor may be a device (a gyrocompass) in which a north-pointing device and a damping device are added to a gyroscope that rotates at a high speed so that north is indicated all the time.

In yet another example, the direction sensor may be a GPS compass that includes a plurality of GPS antennas and calculates the heading from a relative locational relationship of the plurality of GPS antennas.

In the examples shown in FIG. 1 and FIG. 2, the communication unit 11J communicates with the communication device 12.

The communication device 12 is carried by the above-described overboard fall detection target person (occupant). The communication device 12 includes a communication device location detection unit 12A, a communication unit 12B, and an input unit 12C.

The communication device location detection unit 12A detects the location of the communication device 12. The communication device location detection unit 12A includes, for example, a GPS device. The GPS device calculates location coordinates of the communication device 12 by receiving signals from a plurality of GPS satellites.

The input unit 12C receives, for example, the automatic maneuvering start request from the watercraft operator of the watercraft 11 (for example, the automatic maneuvering start request from the watercraft operator who has fallen overboard from the watercraft 11 while carrying the communication device 12).

The communication unit 12B transmits information indicating the location of the communication device 12 detected by the communication device location detection unit 12A to the watercraft 11. The communication unit 11J of the watercraft 11 receives the information indicating the location of the communication device 12 transmitted by the communication unit 12B. The location of the communication device 12 detected by the communication device location detection unit 12A is used for controlling the automatic maneuvering mode of the watercraft control device 11C.

Also, the communication unit 12B transmits the automatic maneuvering start request received by the input unit 12C to the watercraft 11. The communication unit 11J of the watercraft 11 receives the automatic maneuvering start request transmitted by the communication unit 12B. As described above, the automatic maneuvering start instruction unit 11G2 of the watercraft 11 outputs the automatic maneuvering start instruction on the basis of the automatic maneuvering start request transmitted from the communication device 12.

In another example, the communication device 12 may not include the input unit 12C. In the present example, the communication unit 12B does not transmit the automatic maneuvering start request to the watercraft 11 and the watercraft control device 11C starts the control of the automatic maneuvering mode on the basis of a trigger generated by the trigger generation unit 11G.

Although the trigger generation unit 11G of the watercraft 11 generates a trigger for switching the mode of the watercraft control device 11C from the manual maneuvering mode to the automatic maneuvering mode in the examples shown in FIG. 1 and FIG. 2, a function of generating a trigger for switching the mode of the watercraft control device 11C from the manual maneuvering mode to the automatic maneuvering mode may be provided in the communication device 12 in another example.

In the examples shown in FIG. 1 and FIG. 2, as described above, relative locations of the watercraft 11 and the communication device 12 are calculated on the basis of a location of the watercraft 11 detected by the watercraft location detection unit 11H and a location of the communication device 12 detected by the communication device location detection unit 12A and the calculated locations are used for controlling the automatic maneuvering mode of the watercraft control device 11C. In another example, the watercraft 11 includes a relative location detection unit such as a camera or radar, the relative location detection unit detects relative locations of the watercraft 11 and the communication device 12 and the detected relative locations may be used for controlling the automatic maneuvering mode of the watercraft control device 11C.

In the examples shown in FIG. 1 and FIG. 2, the angle detection unit 11K includes, for example, a potentiometer, and detects an angle of the rudder unit 11A1 (a rudder angle). During the automatic maneuvering mode, the watercraft control device 11C controls the drive unit 11E on the basis of the angle of the rudder unit 11A1 detected by the angle detection unit 11K. For example, during the automatic maneuvering mode, the watercraft control device 11C controls the drive unit 11E so that the angle of the rudder unit 11A1 detected by the angle detection unit 11K matches a target angle of the rudder unit 11A1 calculated on the basis of the relative locations of the watercraft 11 and the communication device 12 and the heading.

Figure 3:
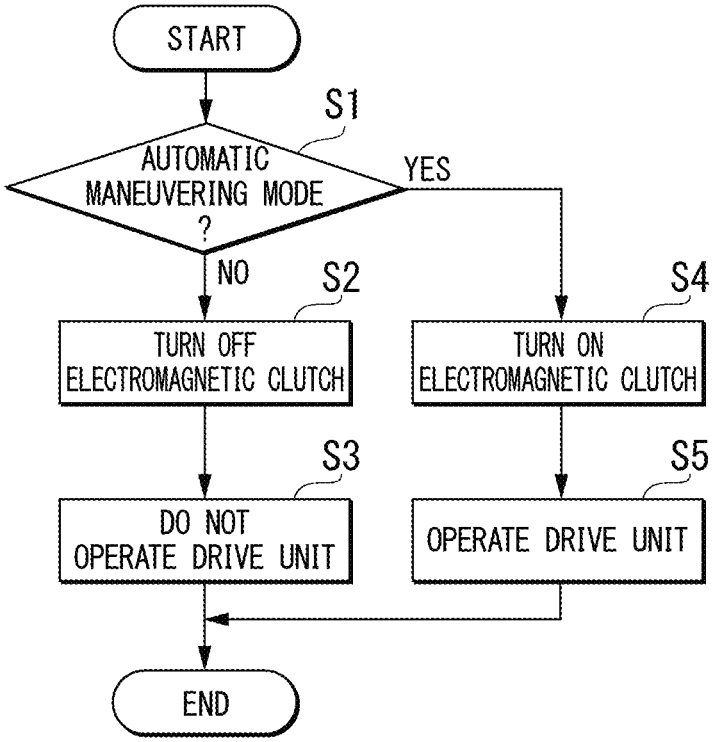
FIG. 3 is a flowchart for describing an example of a process executed in the automatic maneuvering system of the first embodiment.

FIG. 3 is a flowchart for describing an example of a process executed in the automatic maneuvering system 1 of the first embodiment.

In the example shown in FIG. 3, in step S1, for example, the watercraft control device 11C of the watercraft 11 determines whether or not the mode is in the automatic maneuvering mode (in detail, whether or not the overboard fall detection unit 11G1 has detected the falling of the occupant of the watercraft 11 overboard). When the mode is not the automatic maneuvering mode (in detail, when the overboard fall detection unit 11G1 has not detected the falling of the occupant of the watercraft 11 overboard), the process proceeds to step S2. On the other hand, when the mode is the automatic maneuvering mode (in detail, when the overboard fall detection unit 11G1 has detected the falling of the occupant of the watercraft 11 overboard), the process proceeds to step S4.

In step S2, the third control unit 11C3 of the watercraft control device 11C turns off the electromagnetic clutch 11F1.

Also, in step S3, the second control unit 11C2 of the watercraft control device 11C does not operate the drive unit 11E (for example, a current-carrying process for the motor is not performed).

In step S4, the third control unit 11C3 of the watercraft control device 11C turns on the electromagnetic clutch 11F1.

Also, in step S5, the second control unit 11C2 of the watercraft control device 11C operates the drive unit 11E (for example, a current-carrying process for the motor is performed) on the basis of the relative locations of the watercraft 11 and the communication device 12 and the heading.

Second Embodiment

A second embodiment of a watercraft, a watercraft control device, a watercraft control method, and a program of the present invention will be described below.

An automatic maneuvering system 1 of the second embodiment is configured like the automatic maneuvering system 1 of the first embodiment described above, except for differences to be described below. Accordingly, according to the automatic maneuvering system 1 of the second embodiment, it is possible to obtain effects similar to those of the automatic maneuvering system 1 of the first embodiment described above, except for the differences to be described below.

Figure 4:
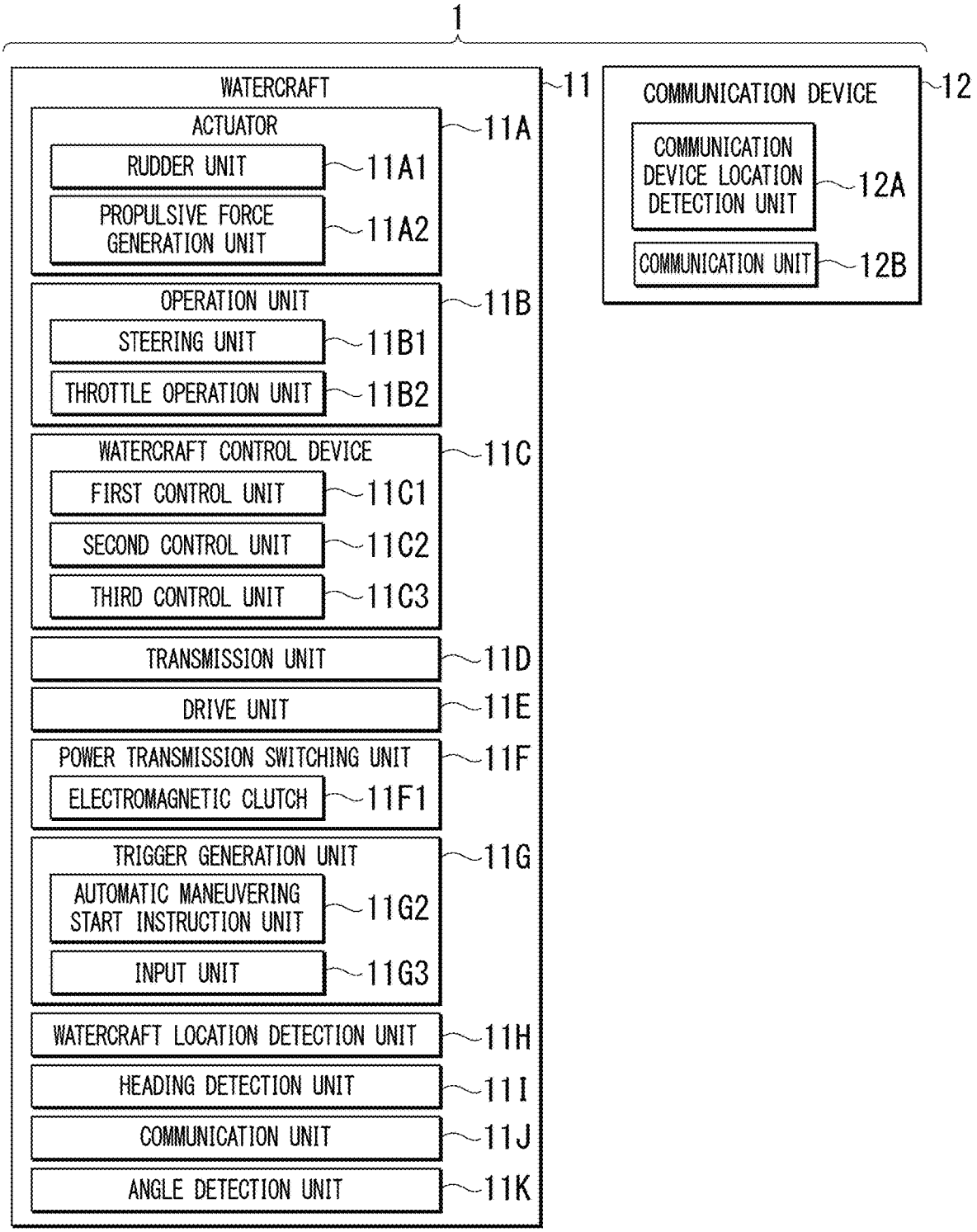
FIG. 4 is a diagram schematically showing an example of an automatic maneuvering system to which a watercraft of a second embodiment is applied.

FIG. 4 is a diagram schematically showing an example of the automatic maneuvering system 1 to which a watercraft 11 of the second embodiment is applied.

In the example shown in FIG. 4, the automatic maneuvering system 1 includes a watercraft 11 and a communication device 12.

The watercraft 11 of the second embodiment is, for example, a PWC having functions similar to those of the PWC described in FIG. 1 of Japanese Patent No. 5196649. The watercraft 11 includes an actuator 11A configured like the actuator 11A of the first embodiment, an operation unit 11B configured like the operation unit 11B of the first embodiment, a watercraft control device 11C configured like the watercraft control device 11C of the first embodiment, a transmission unit 11D configured like the transmission unit 11D of the first embodiment, a drive unit 11E configured like the drive unit 11E of the first embodiment, a power transmission switching unit 11F configured like the power transmission switching unit 11F of the first embodiment, a trigger generation unit 11G, a watercraft location detection unit 11H configured like the watercraft location detection unit 11H of the first embodiment, a heading detection unit 11I configured like the heading detection unit 11I of the first embodiment, a communication unit 11J configured like the communication unit 11J of the first embodiment, and an angle detection unit 11K configured like the angle detection unit 11K of the first embodiment.

The trigger generation unit 11G generates a trigger for switching the mode of the watercraft control device 11C from a manual maneuvering mode to an automatic maneuvering mode. The trigger generation unit 11G includes an automatic maneuvering start instruction unit 11G2 and an input unit 11G3.

The input unit 11G3 receives an automatic maneuvering start request from an occupant of the watercraft 11 (in detail, an occupant who has not fallen overboard). When the input unit 11G3 receives the automatic maneuvering start request from the occupant of the watercraft 11, the trigger generation unit 11G generates a trigger and the watercraft control device 11C switches the mode from the manual maneuvering mode to the automatic maneuvering mode.

The automatic maneuvering start instruction unit 11G2 outputs an automatic maneuvering start instruction on the basis of the automatic maneuvering start request received by the input unit 11G3. When the automatic maneuvering start instruction unit 11G2 outputs the automatic maneuvering start instruction, the watercraft control device 11C starts a control process of operating the actuator 11A (a process of controlling the automatic maneuvering mode) without any need for the operation unit 11B to receive an input operation. In the automatic maneuvering mode, the watercraft control device 11C controls the actuator 11A on the basis of the relative locations of the watercraft 11 and the communication device 12 (in detail, the communication device 12 carried by the watercraft operator who has not fallen overboard from the watercraft 11) and the heading of the watercraft 11.

That is, in the example shown in FIG. 4, when the input unit 11G3 has not received an automatic maneuvering start request from the occupant of the watercraft 11 (during the manual maneuvering mode), the electromagnetic clutch 11F1 does not connect the transmission unit 11D and the drive unit 11E. On the other hand, when the input unit 11G3 has received the automatic maneuvering start request from the occupant of the watercraft 11 (during the automatic maneuvering mode), the electromagnetic clutch 11F1 connects the transmission unit 11D and the drive unit 11E.

In another example, the trigger generation unit 11G may not include the automatic maneuvering start instruction unit 11G2. In the present example, when the input unit 11G3 receives the automatic maneuvering start request from the occupant of the watercraft 11, the trigger generation unit 11G generates a trigger and the watercraft control device 11C switches the mode from the manual maneuvering mode to the automatic maneuvering mode and also starts the control of the automatic maneuvering mode.

In the example shown in FIG. 4, the communication device 12 is carried by an occupant of the watercraft 11 (in detail, an occupant who has not fallen overboard). The communication device 12 includes a communication device location detection unit 12A and a communication unit 12B.

The communication device location detection unit 12A detects the location of the communication device 12.

The communication unit 12B transmits information indicating the location of the communication device 12 detected by the communication device location detection unit 12A to the watercraft 11. The communication unit 11J of the watercraft 11 receives the information indicating the location of the communication device 12 transmitted by the communication unit 12B. The location of the communication device 12 detected by the communication device location detection unit 12A is used for controlling the automatic maneuvering mode of the watercraft control device 11C.

In the example shown in FIG. 4, because the occupant of the watercraft 11 has not fallen overboard, the location of the communication device 12 detected by the communication device location detection unit 12A roughly matches the location of the watercraft 11 detected by the watercraft location detection unit 11H. As a result, the propulsive force generation unit 11A2 does not generate a propulsive force for the watercraft 11 during the automatic maneuvering mode. Also, during the automatic maneuvering mode, the third control unit 11C3 of the watercraft control device 11C operates the electromagnetic clutch 11F1 (turns on the electromagnetic clutch 11F1). Further, the second control unit 11C2 of the watercraft control device 11C operates the drive unit 11E on the basis of an angle of the rudder unit 11A1 (a rudder angle) detected by the angle detection unit 11K. In detail, the second control unit 11C2 of the watercraft control device 11C operates the drive unit 11E (for example, holds the motor) so that the angle of the rudder unit 11A1 (the rudder angle) detected by the angle detection unit 11K is maintained.

Thus, in the example shown in FIG. 4, during the automatic maneuvering mode, the occupant of the watercraft 11 can take a rest or the like by causing the watercraft 11 to be stabilized without having to operate the steering unit 11B1 (for example, in a state in which his or her hands are separated from the steering unit 11B1).

Third Embodiment

A third embodiment of a watercraft, a watercraft control device, a watercraft control method, and a program of the present invention will be described below.

An automatic maneuvering system 1 of the third embodiment is configured like the automatic maneuvering system 1 of the first embodiment described above, except for differences to be described below. Accordingly, according to the automatic maneuvering system 1 of the third embodiment, it is possible to obtain effects similar to those of the automatic maneuvering system 1 of the first embodiment described above, except for the differences to be described below.

Figure 5:
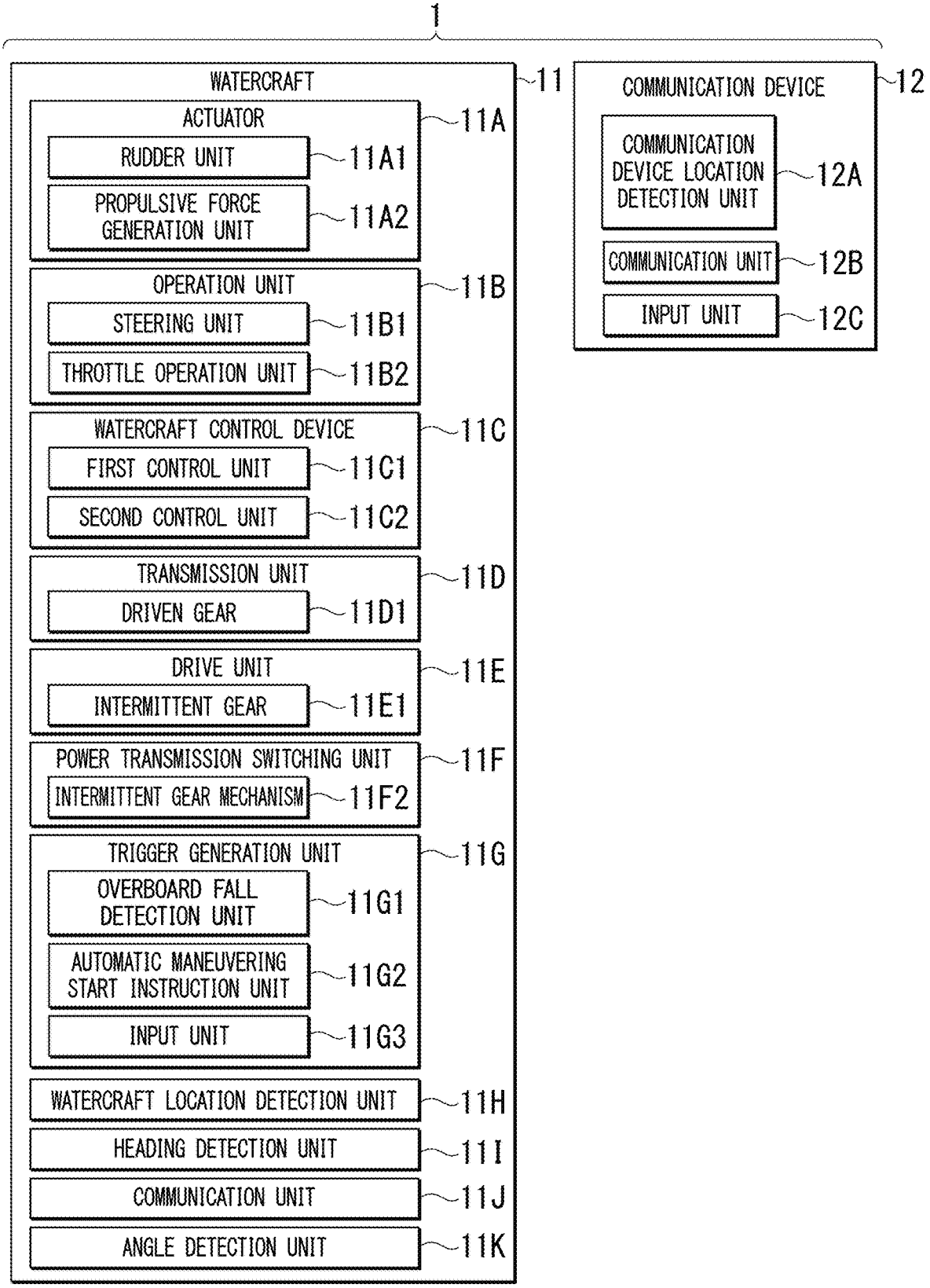
FIG. 5 is a diagram schematically showing an example of an automatic maneuvering system to which a watercraft of a third embodiment is applied.

FIG. 5 is a diagram schematically showing an example of the automatic maneuvering system 1 to which the watercraft 11 of the third embodiment is applied.

In the example shown in FIG. 5, the automatic maneuvering system 1 includes a watercraft 11 and a communication device 12.

The watercraft 11 of the third embodiment is, for example, a PWC having functions similar to those of the PWC described in FIG. 1 of Japanese Patent No. 5196649. The watercraft 11 includes an actuator 11A configured like the actuator 11A of the first embodiment, an operation unit 11B configured like the operation unit 11B of the first embodiment, a watercraft control device 11C, a transmission unit 11D, a drive unit 11E, a power transmission switching unit 11F, a trigger generation unit 11G like the trigger generation unit 11G of the first embodiment, a watercraft location detection unit 11H configured like the watercraft location detection unit 11H of the first embodiment, a heading detection unit 11I configured like the heading detection unit 11I of the first embodiment, a communication unit 11J configured like the communication unit 11J of the first embodiment, and an angle detection unit 11K configured like the angle detection unit 11K of the first embodiment.

The watercraft control device 11C performs a control process of operating the actuator 11A or the like on the basis of an input operation of a watercraft operator received by the operation unit 11B. The watercraft control device 11C has a manual maneuvering mode in which the actuator 11A is operated on the basis of an input operation on the operation unit 11B and an automatic maneuvering mode in which the actuator 11A is operated without any need of an input operation on the operation unit 11B.

The watercraft control device 11C includes a first control unit 11C1 and a second control unit 11C2.

The first control unit 11C1 controls a propulsive force generation unit 11A2. In detail, during the manual maneuvering mode, the first control unit 11C1 performs a control process of operating the propulsive force generation unit 11A2 on the basis of an input operation of the watercraft operator received by the throttle operation unit 11B2. During the automatic maneuvering mode, the first control unit 11C1 performs a control process of operating the propulsive force generation unit 11A2 on the basis of relative locations of the watercraft 11 and the communication device 12 and heading.

The second control unit 11C2 controls the drive unit 11E. In detail, during the manual maneuvering mode, the second control unit 11C2 does not operate the drive unit 11E. On the other hand, during the automatic maneuvering mode, the second control unit 11C2 performs a control process of operating the drive unit 11E on the basis of the relative locations of the watercraft 11 and the communication device 12 and the heading.

The transmission unit 11D has, for example, a mechanical cable that connects the steering unit 11B1 and the rudder unit 11A1. The transmission unit 11D mechanically transmits an input operation on the steering unit 11B1 to the rudder unit 11A1. The transmission unit 11D includes a driven gear 11D1 (see FIGS. 6A-FIG. 6C and FIG. 7A and FIG. 7B).

The drive unit 11E has, for example, a motor, and operates the rudder unit 11A1 during the automatic maneuvering mode. In detail, during the automatic maneuvering mode, the drive unit 11E operates the rudder unit 11A1 without any need of an input operation on the steering unit 11B1. On the other hand, during the manual maneuvering mode, the drive unit 11E does not operate the rudder unit 11A1. The drive unit 11E includes an intermittent gear 11E1 (see FIGS. 6A-FIG. 6C and FIG. 7A and FIG. 7B) as an output gear that outputs a driving force for operating the rudder unit 11A1. The intermittent gear 11E1 is configured to engage with the driven gear 11D1 of the transmission unit 11D.

The power transmission switching unit 11F switches power transmission from the drive unit 11E to the rudder unit 11A1 during the manual maneuvering mode and during the automatic maneuvering mode. The power transmission switching unit 11F is provided between the transmission unit 11D and the drive unit 11E. The power transmission switching unit 11F functions as a part of a connection mechanism that connects the drive unit 11E and the rudder unit 11A1. The power transmission switching unit 11F includes an intermittent gear mechanism 11F2 (see FIGS. 6A-FIG. 6C and FIG. 7A and FIG. 7B). The intermittent gear mechanism 11F2 includes at least the intermittent gear 11E1 and the driven gear 11D1. That is, the connection mechanism includes the intermittent gear mechanism 11F2.

During the manual maneuvering mode, the intermittent gear 11E1 does not engage with the driven gear 11D1 and the driving force of the drive unit 11E is not transmitted to the rudder unit 11A1.

On the other hand, during the automatic maneuvering mode, the intermittent gear 11E1 is able to engage with the driven gear 11D1 and the driving force of the drive unit 11E is transmitted to the rudder unit 11A1 when the intermittent gear 11E1 engages with the driven gear 11D1.

Figures 6A, 6B, 6C:
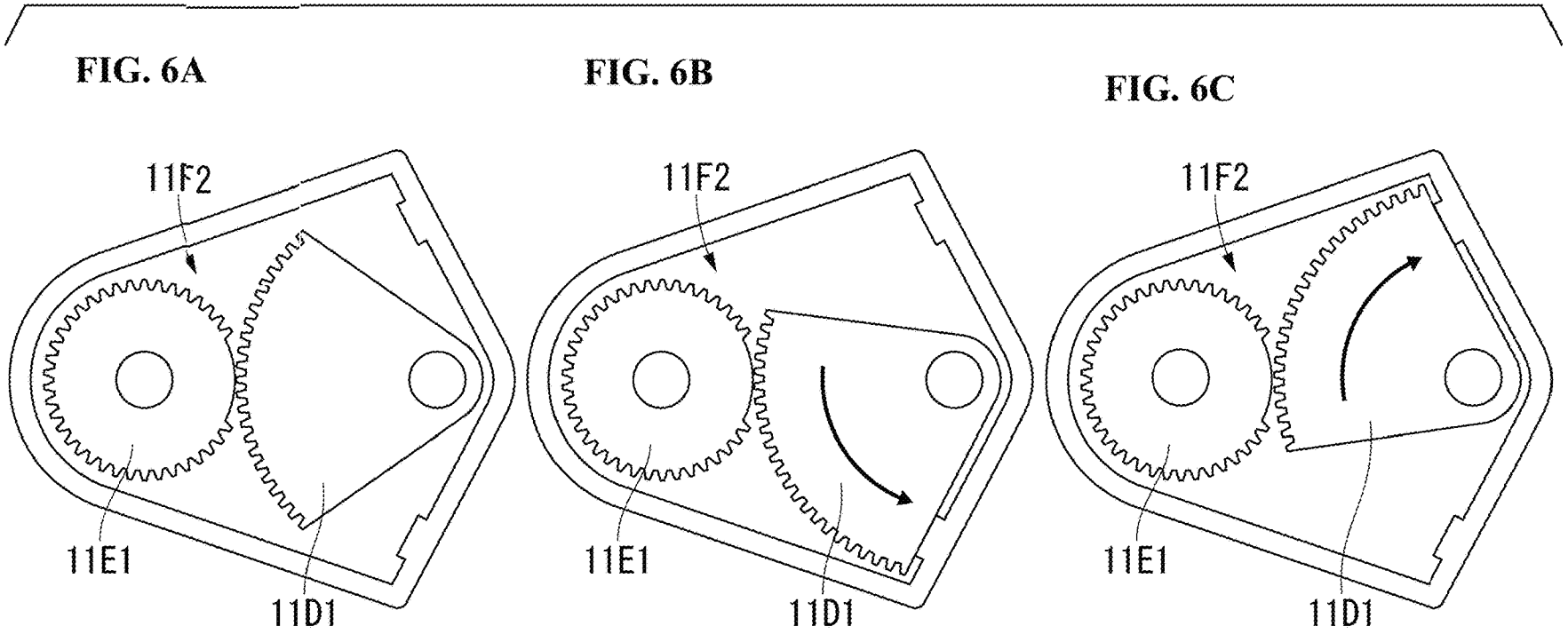
FIGS. 6A-FIG. 6C is a diagram showing an example of a relationship between an intermittent gear and a driven gear during a manual maneuvering mode.

FIGS. 6A-FIG. 6C are diagrams showing an example of a relationship between the intermittent gear 11E1 and the driven gear 11D1 during the manual maneuvering mode. In detail, FIG. 6A shows an example of a relationship between the intermittent gear 11E1 and the driven gear 11D1 when the watercraft 11 in the manual maneuvering mode moves straight, FIG. 6B shows an example of a relationship between the intermittent gear 11E1 and the driven gear 11D1 during the left steering of the watercraft 11 in the manual maneuvering mode, and FIG. 6C shows an example of a relationship between the intermittent gear 11E1 and the driven gear 11D1 during the right steering of the watercraft 11 in the manual maneuvering mode.

As shown in FIGS. 6A-FIG. 6C, the intermittent gear 11E1 does not engage with the driven gear 11D1 during the manual maneuvering mode. Thus, the driving force of the drive unit 11E is not transmitted to the rudder unit 11A1. In detail, during the manual maneuvering mode, the drive unit 11E does not generate a driving force (for example, the motor does not rotate).

In the example shown in FIGS. 6A-FIG. 6C, during the left steering of the watercraft 11 in the manual maneuvering mode, according to the input operation on the steering unit 11B1 by the watercraft operator of the watercraft 11, the driven gear 11D1 is rotated counterclockwise as compared with when the watercraft 11 moves straight in the manual maneuvering mode (see FIG. 6B). On the other hand, during the right steering of the watercraft 11 in the manual maneuvering mode, according to the input operation on the steering unit 11B1 by the watercraft operator of the watercraft 11, the driven gear 11D1 is rotated clockwise as compared with when the watercraft 11 moves straight in the manual maneuvering mode (see FIG. 6C).

Figure 7B:
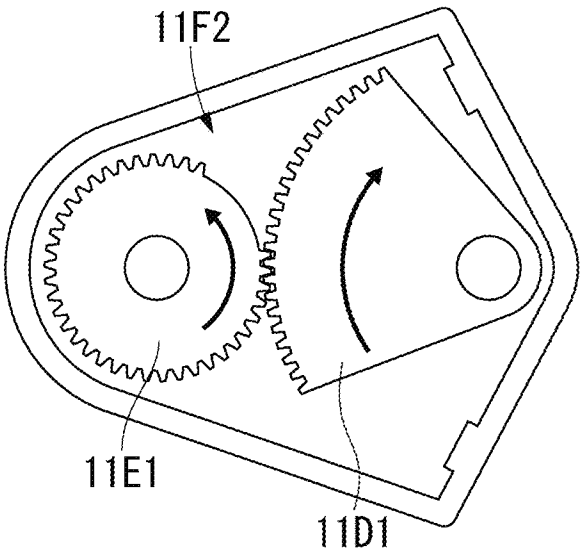
FIG. 7A and FIG. 7B is a diagram showing an example of a relationship between the intermittent gear and the driven gear during an automatic maneuvering mode.
Figure 7A:
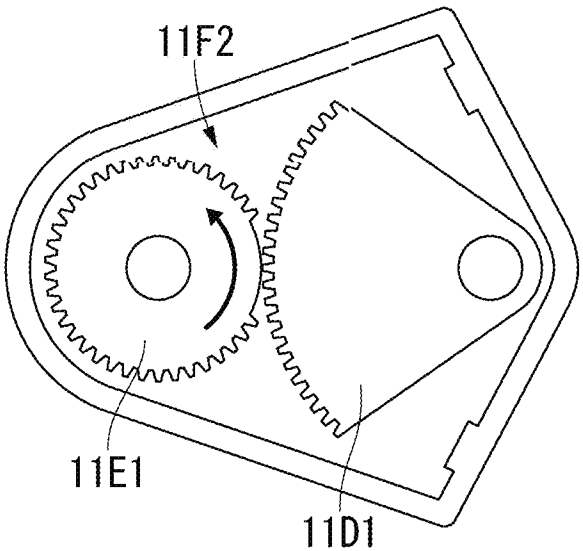

FIG. 7A and FIG. 7B are diagrams showing an example of a relationship between the intermittent gear 11E1 and the driven gear 11D1 during the automatic maneuvering mode.

In detail, FIG. 7A shows an example of a relationship between the intermittent gear 11E1 and the driven gear 11D1 when the mode is switched from the manual maneuvering mode to the automatic maneuvering mode and FIG. 7B shows the rotation of the driven gear 11D1 according to the rotation of the intermittent gear 11E1 during the automatic maneuvering mode.

As shown in FIG. 7A, when the mode is switched from the manual maneuvering mode to the automatic maneuvering mode, the state changes from a state in which the intermittent gear 11E1 has not engaged with the driven gear 11D1 to a state in which the intermittent gear 11E1 has engaged with the driven gear 11D1 according to the rotation of the intermittent gear 11E1.

As shown in FIG. 7B, during the automatic maneuvering mode, the intermittent gear 11E1 engages with the driven gear 11D1. For example, when the intermittent gear 11E1 rotates counterclockwise, the driven gear 11D1 rotates clockwise. That is, the driving force of the drive unit 11E is transmitted to the rudder unit 11A1 via the transmission unit 11D.

In the watercraft 11 of the third embodiment, when the overboard fall detection unit 11G1 has not detected the falling of an occupant of the watercraft 11 overboard (during the manual maneuvering mode), the driven gear 11D1 does not engage with the intermittent gear 11E1 as shown in FIGS. 6A-FIG. 6C. When the overboard fall detection unit 11G1 has detected the falling of an occupant of the watercraft 11 overboard (during the automatic maneuvering mode), the driven gear 11D1 is able to engage with the intermittent gear 11E1, as shown in FIG. 7A and FIG. 7B.

That is, when the automatic maneuvering mode starts, the drive unit 11E outputs a driving force for operating the rudder unit 11A1, so that the intermittent gear mechanism 11F2 connects the drive unit 11E and the rudder unit 11A1 and the rudder unit 11A1 is operated by the drive unit 11E.

Fourth Embodiment

A fourth embodiment of a watercraft, a watercraft control device, a watercraft control method, and a program of the present invention will be described below.

An automatic maneuvering system 1 of the fourth embodiment is configured like the automatic maneuvering system 1 of the third embodiment described above, except for differences to be described below. Accordingly, according to the automatic maneuvering system 1 of the fourth embodiment, it is possible to obtain effects similar to those of the automatic maneuvering system 1 of the third embodiment described above, except for the differences to be described below.

Figure 8:
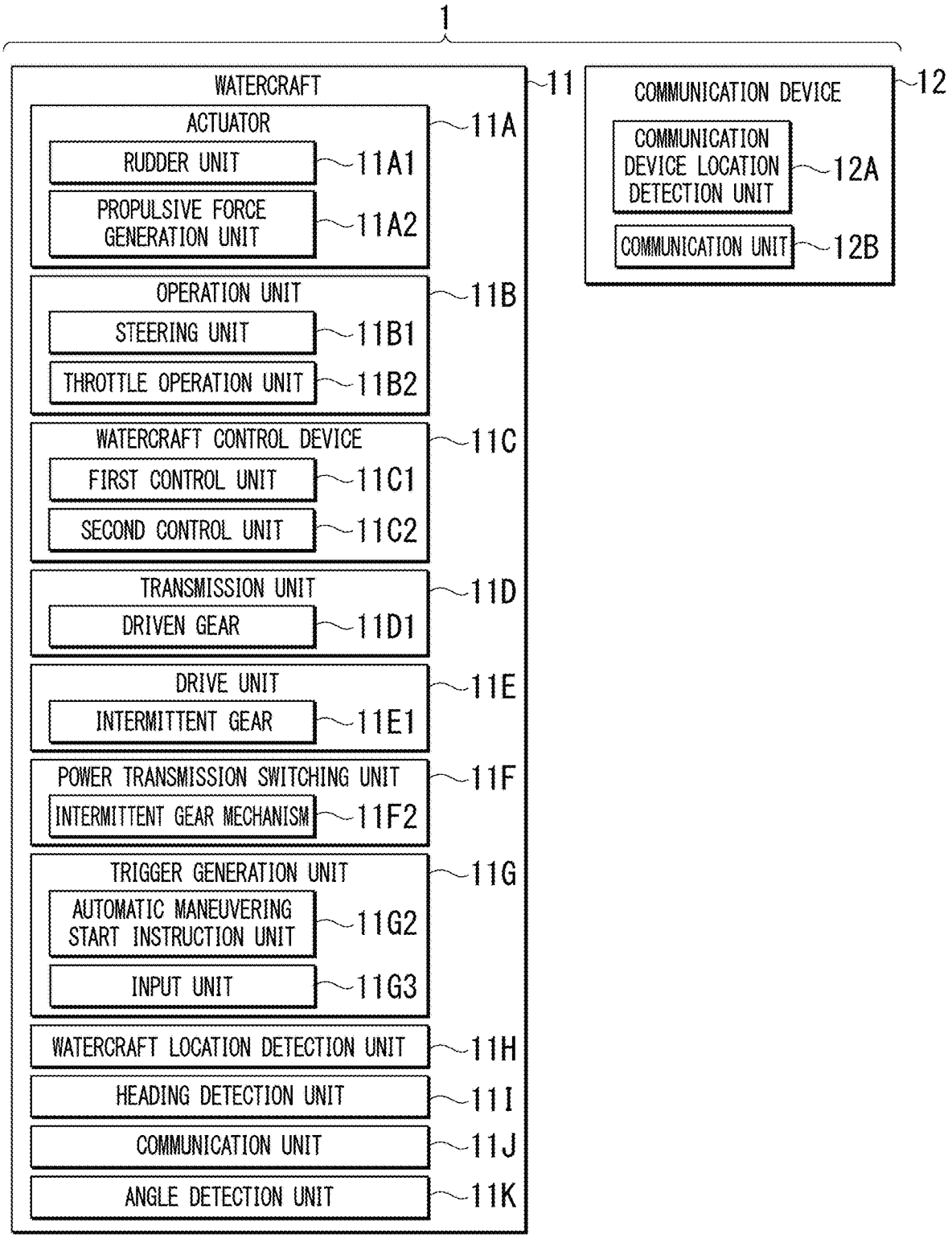
FIG. 8 is a diagram schematically showing an example of an automatic maneuvering system to which a watercraft of a fourth embodiment is applied.

FIG. 8 is a diagram schematically showing an example of an automatic maneuvering system 1 to which a watercraft 11 of the fourth embodiment is applied.

In the example shown in FIG. 8, the automatic maneuvering system 1 includes the watercraft 11 and a communication device 12.

The watercraft 11 of the fourth embodiment is, for example, a PWC having functions similar to those of the PWC described in FIG. 1 of Japanese Patent No. 5196649. The watercraft 11 includes an actuator 11A configured like the actuator 11A of the third embodiment, an operation unit 11B configured like the operation unit 11B of the third embodiment, a watercraft control device 11C configured like the watercraft control device 11C of the third embodiment, a transmission unit 11D configured like the transmission unit 11D of the third embodiment, a drive unit 11E configured like the drive unit 11E of the third embodiment, a power transmission switching unit 11F configured like the power transmission switching unit 11F of the third embodiment, a trigger generation unit 11G, a watercraft location detection unit 11H configured like the watercraft location detection unit 11H of the third embodiment, a heading detection unit 11I configured like the heading detection unit 11I of the third embodiment, a communication unit 11J configured like the communication unit 11J of the third embodiment, and an angle detection unit 11K configured like the angle detection unit 11K of the third embodiment.

The trigger generation unit 11G generates a trigger for switching the mode of the watercraft control device 11C from a manual maneuvering mode to an automatic maneuvering mode. The trigger generation unit 11G includes an automatic maneuvering start instruction unit 11G2 and an input unit 11G3.

The input unit 11G3 receives an automatic maneuvering start request from an occupant of the watercraft 11 (in detail, an occupant who has not fallen overboard). When the input unit 11G3 receives the automatic maneuvering start request from the occupant of the watercraft 11, the trigger generation unit 11G generates a trigger and the watercraft control device 11C switches the mode from the manual maneuvering mode to the automatic maneuvering mode.

The automatic maneuvering start instruction unit 11G2 outputs an automatic maneuvering start instruction on the basis of the automatic maneuvering start request received by the input unit 11G3. When the automatic maneuvering start instruction unit 11G2 outputs the automatic maneuvering start instruction, the watercraft control device 11C starts a control process of operating the actuator 11A (a process of controlling the automatic maneuvering mode) without any need for the operation unit 11B to receive an input operation. In the automatic maneuvering mode, the watercraft control device 11C controls the actuator 11A on the basis of relative locations of the watercraft 11 and the communication device 12 (in detail, the communication device 12 carried by the watercraft operator who has not fallen overboard from the watercraft 11) and heading of the watercraft 11.

That is, when the input unit 11G3 has not received an automatic maneuvering start request from the occupant of the watercraft 11 (during the manual maneuvering mode) in the example shown in FIG. 8, the driven gear 11D1 does not engage with the intermittent gear 11E1 as shown in FIG. 6. On the other hand, when the input unit 11G3 has received the automatic maneuvering start request from the occupant of the watercraft 11 (during the automatic maneuvering mode), the driven gear 11D1 is able to engage with the intermittent gear 11E1 as shown in FIG. 7A and FIG. 7B.

In another example, the trigger generation unit 11G may not include the automatic maneuvering start instruction unit 11G2. In the present example, when the input unit 11G3 receives the automatic maneuvering start request from the occupant of the watercraft 11, the trigger generation unit 11G generates a trigger and the watercraft control device 11C switches the mode from the manual maneuvering mode to the automatic maneuvering mode and also starts the control of the automatic maneuvering mode.

In the example shown in FIG. 8, the communication device 12 is carried by an occupant of the watercraft 11 (in detail, an occupant who has not fallen overboard). The communication device 12 includes a communication device location detection unit 12A and a communication unit 12B.

The communication device location detection unit 12A detects the location of the communication device 12.

The communication unit 12B transmits information indicating the location of the communication device 12 detected by the communication device location detection unit 12A to the watercraft 11. The communication unit 11J of the watercraft 11 receives the information indicating the location of the communication device 12 transmitted by the communication unit 12B. The location of the communication device 12 detected by the communication device location detection unit 12A is used for controlling the automatic maneuvering mode of the watercraft control device 11C.

In the example shown in FIG. 8, because the occupant of the watercraft 11 has not fallen overboard, the location of the communication device 12 detected by the communication device location detection unit 12A roughly matches the location of the watercraft 11 detected by the watercraft location detection unit 11H. As a result, the propulsive force generation unit 11A2 does not generate a propulsive force for the watercraft 11 during the automatic maneuvering mode. Also, during the automatic maneuvering mode, the driven gear 11D1 engages with the intermittent gear 11E1 as shown in FIG. 7A and FIG. 7B. Further, the second control unit 11C2 of the watercraft control device 11C operates the drive unit 11E on the basis of an angle of the rudder unit 11A1 (a rudder angle) detected by the angle detection unit 11K. In detail, the second control unit 11C2 of the watercraft control device 11C operates the drive unit 11E (for example, holds the motor) so that the angle of the rudder unit 11A1 (the rudder angle) detected by the angle detection unit 11K is maintained.

Thus, in the example shown in FIG. 8, during the automatic maneuvering mode, the occupant of the watercraft 11 can take a rest or the like by causing the watercraft 11 to be stabilized without having to operate the steering unit 11B1 (for example, in a state in which his or her hands are separated from the steering unit 11B1).

Fifth Embodiment

A fifth embodiment of a watercraft, a watercraft control device, a watercraft control method, and a program of the present invention will be described below.

An automatic maneuvering system 1 of the fifth embodiment is configured like the automatic maneuvering system 1 of the first embodiment described above, except for differences to be described below. Accordingly, according to the automatic maneuvering system 1 of the fifth embodiment, it is possible to obtain effects similar to those of the automatic maneuvering system 1 of the first embodiment described above, except for the differences to be described below.

As described above, in the automatic maneuvering system 1 of the first embodiment, the overboard fall detection unit 11G1 of the watercraft 11 is configured like, for example, the lanyard cord and the switch described in paragraph 0002 of Japanese Patent No. 4205261, and detects the falling of an occupant of the watercraft 11 (for example, a watercraft operator or an occupant other than the watercraft operator) overboard when the other end of the lanyard cord has been disconnected from the switch.

On the other hand, in the automatic maneuvering system 1 of the fifth embodiment, the overboard fall detection unit 11G1 detects the falling of an occupant of the watercraft 11 overboard on the basis of a distance between a location of the watercraft 11 detected by the watercraft location detection unit 11H and a location of the communication device 12 detected by the communication device location detection unit 12A of the communication device 12. In detail, when the distance between the location of the watercraft 11 and the location of the communication device 12 is greater than a prescribed threshold value, the overboard fall detection unit 11G1 estimates that the occupant of the watercraft 11 has fallen overboard.

As a result, the trigger generation unit 11G generates a trigger, the watercraft control device 11C is in the automatic maneuvering mode and operates the actuator 11A on the basis of relative locations of the watercraft 11 and the communication device 12 and heading of the watercraft 11. That is, the watercraft control device 11C starts the control of the automatic maneuvering mode.

Sixth Embodiment

A sixth embodiment of a watercraft, a watercraft control device, a watercraft control method, and a program of the present invention will be described below.

An automatic maneuvering system 1 of the sixth embodiment is configured like the automatic maneuvering system 1 of the first embodiment described above, except for differences to be described below. Accordingly, according to the automatic maneuvering system 1 of the sixth embodiment, it is possible to obtain effects similar to those of the automatic maneuvering system 1 of the first embodiment described above, except for the differences to be described below.

As described above, the watercraft 11 of the first embodiment is, for example, a PWC (a water-motorcycle) having functions similar to those of the PWC described in FIG. 1 of Japanese Patent No. 5196649.

On the other hand, the watercraft 11 of the sixth embodiment is, for example, a watercraft having functions similar to those of the watercraft described in FIG. 1 of Japanese Patent No. 6198192.

An actuator 11A of the watercraft 11 of the sixth embodiment includes a rudder unit 11A1 and a propulsive force generation unit 11A2. The rudder unit 11A1 has a function of generating a turning moment in the watercraft 11. The propulsive force generation unit 11A2 has a function of generating a propulsive force for the watercraft 11. The actuator 11A includes, for example, the outboard motor, the engine, the actuator, the shift mechanism, and the like described in FIG. 1 of Japanese Patent No. 6198192.

The operation unit 11B of the watercraft 11 of the sixth embodiment includes a steering unit 11B1 and a throttle operation unit 11B2. The steering unit 11B1 receives an input operation by a watercraft operator who operates the rudder unit 11A1. The throttle operation unit 11B2 receives an input operation by the watercraft operator who operates the propulsive force generation unit 11A2. The operation unit 11B is configured like, for example, the steering wheel, the remote-control device, the operation lever, and the like described in FIG. 1 of Japanese Patent No. 6198192. For example, a joystick and the like may be included in the operation unit 11B of the watercraft 11 of the sixth embodiment.

Although modes for carrying out the present invention have been described using embodiments, the present invention is not limited to the embodiments and various modifications and substitutions can also be made without departing from the scope and spirit of the present invention. The configurations described in the above-described embodiments and examples may be combined.

Also, all or some of the functions of the parts provided in the automatic maneuvering system 1 according to the above-described embodiment may be implemented by recording a program for implementing the functions on a computer-readable recording medium and causing a computer system to read and execute the program recorded on the recording medium. Also, the "computer system" described here is assumed to include an operating system (OS) and hardware such as peripheral devices.

Also, the "computer-readable recording medium" refers to a flexible disk, a magneto-optical disc, a read only memory (ROM), a portable medium such as a compact disc (CD)-ROM, or a storage unit such as a hard disk embedded in the computer system. Further, the "computer-readable recording medium" may include a computer-readable recording medium for dynamically retaining the program for a short time period as in a communication line when the program is transmitted via a network such as the Internet or a communication circuit such as a telephone circuit and a computer-readable recording medium for retaining the program for a given time period as in a volatile memory inside the computer system serving as a server or a client when the program is transmitted. Also, the above-described program may be a program for implementing some of the above-described functions. Further, the above-described program may be a program capable of implementing the above-described function in combination with a program already recorded on the computer system.

REFERENCE SIGNS LIST

1 Automatic maneuvering system
11 Watercraft
11A Actuator
11A1 Rudder unit
11A2 Propulsive force generation unit
11B Operation unit
11B1 Steering unit
11B2 Throttle operation unit
11C Watercraft control device
11C1 First control unit
11C2 Second control unit
11C3 Third control unit
11D Transmission unit
11D1 Driven gear
11E Drive unit
11E1 Intermittent gear
11F Power transmission switching unit
11F1 Electromagnetic clutch
11F2 Intermittent gear mechanism
11G Trigger generation unit
11G1 Overboard fall detection unit
11G2 Automatic maneuvering start instruction unit
11G3 Input unit
11H Watercraft location detection unit
11I Heading detection unit
11J Communication unit
11K Angle detection unit
12 Communication device
12A Communication device location detection unit
12B Communication unit
12C Input unit

The invention claimed is:

1. A watercraft comprising:
a steering unit;
a rudder unit;
a transmission unit configured to connect the steering unit and the rudder unit and mechanically transmit an input operation on the steering unit to the rudder unit;
a drive unit configured to operate the rudder unit without any need for an input operation on the steering unit,
a connection mechanism configured to connect the drive unit and the rudder unit,
a watercraft control device configured to control the drive unit, and communicate with a communication device carried by an occupant of the watercraft; and
an overboard fall detection unit configured to detect a falling of the occupant of the watercraft overboard;
wherein the watercraft has a manual maneuvering mode in which operating the drive unit based on a manual operation to the steering unit and an automatic maneuvering mode in which operating the drive unit without any need for an input operation on the steering unit,
when the overboard fall detection unit detects that the occupant falls overboard from the watercraft or when an request for the automatic maneuvering mode is received from the occupant, the watercraft control device switches from the manual maneuvering mode to the automatic maneuvering mode and control the drive unit based on the relative position between the position of the communication device and the position of the watercraft, and a bow direction of the watercraft,
in the manual maneuvering mode, the connection mechanism does not connect the transmission unit to the drive unit and does not transmit power between the drive unit and the rudder unit,
in the automatic maneuvering mode, the connection mechanism connects the transmission unit to the drive unit and transmits power from the drive unit to the rudder unit.

2. The watercraft according to claim 1, comprising a power transmission switching unit provided between the transmission unit and the drive unit.

3. The watercraft according to claim 1, wherein the connection mechanism includes an electromagnetic clutch.

4. The watercraft according to claim 3,
wherein the watercraft has an automatic maneuvering mode in which the drive unit operates the rudder unit, and
wherein, when the automatic maneuvering mode starts,
the electromagnetic clutch connects the drive unit and the rudder unit by performing a current-carrying process for the electromagnetic clutch, and
the drive unit operates the rudder unit in a state in which the electromagnetic clutch has connected the drive unit and the rudder unit.

5. The watercraft according to claim 3,
wherein the watercraft has a manual maneuvering mode in which the drive unit does not operate the rudder unit and an automatic maneuvering mode in which the drive unit operates the rudder unit,
wherein the electromagnetic clutch does not connect the transmission unit and the drive unit during the manual maneuvering mode, and
wherein the electromagnetic clutch connects the transmission unit and the drive unit during the automatic maneuvering mode.

6. The watercraft according to claim 5,
wherein, when the overboard fall detection unit has not detected the falling of the occupant of the watercraft overboard, the electromagnetic clutch does not connect the transmission unit and the drive unit, and
wherein, when the overboard fall detection unit has detected the falling of the occupant of the watercraft overboard, the electromagnetic clutch connects the transmission unit and the drive unit.

7. The watercraft according to claim 5, comprising an input unit configured to receive an automatic maneuvering start request of the watercraft, wherein, when the input unit has not received the automatic maneuvering start request, the electromagnetic clutch does not connect the transmission unit and the drive unit, and wherein, when the input unit has received the automatic maneuvering start request, the electromagnetic clutch connects the transmission unit and the drive unit.

8. The watercraft according to claim 1, wherein the connection mechanism includes an intermittent gear mechanism.

9. The watercraft according to claim 8, wherein the watercraft has an automatic maneuvering mode in which the drive unit operates the rudder unit, and wherein, when the automatic maneuvering mode starts, the drive unit outputs a driving force for operating the rudder unit, so that the intermittent gear mechanism connects the drive unit and the rudder unit and the rudder unit is operated by the drive unit.

10. The watercraft according to claim 8, wherein the drive unit includes an intermittent gear as an output gear configured to output a driving force for operating the rudder unit, wherein the transmission unit includes a driven gear engaging with the intermittent gear, wherein the intermittent gear mechanism includes at least the intermittent gear and the driven gear, and wherein the driven gear engages with the intermittent gear, so that the driving force is transmitted to the rudder unit.

11. The watercraft according to claim 10, wherein the watercraft has a manual maneuvering mode in which the driving force is not transmitted to the rudder unit and an automatic maneuvering mode in which the driving force is transmitted to the rudder unit, wherein the driven gear does not engage with the intermittent gear during the manual maneuvering mode in which the drive unit does not operate the rudder unit, and wherein the driven gear is able to engage with the intermittent gear during the automatic maneuvering mode in which the drive unit operates the rudder unit.

12. The watercraft according to claim 11, wherein, when the overboard fall detection unit has not detected the falling of the occupant of the watercraft overboard, the driven gear does not engage with the intermittent gear, and wherein, when the overboard fall detection unit has detected the falling of the occupant of the watercraft overboard, the driven gear is able to engage with the intermittent gear.

13. The watercraft according to claim 11, comprising an input unit configured to receive an automatic maneuvering start request of the watercraft, wherein, when the input unit has not received the automatic maneuvering start request, the driven gear does not engage with the intermittent gear, and wherein, when the input unit has received the automatic maneuvering start request, the driven gear is able to engage with the intermittent gear.

14. The watercraft according to claim 4 comprising an angle detection unit configured to detect an angle of the rudder unit, wherein the watercraft control device controls the drive unit on the basis of the angle of the rudder unit detected by the angle detection unit during the automatic maneuvering mode.

15. A watercraft control device provided in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit, wherein a process of controlling the drive unit and a process of controlling the electromagnetic clutch are executed, wherein the watercraft has a manual maneuvering mode in which the drive unit does not operate the rudder unit and an automatic maneuvering mode in which the drive unit operates the rudder unit, wherein the electromagnetic clutch does not connect the transmission unit and the drive unit during the manual maneuvering mode, and wherein the electromagnetic clutch connects the transmission unit and the drive unit during the automatic maneuvering mode.

16. A watercraft control method for use in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit, the watercraft control method comprising:

a drive unit control step of controlling the drive unit; and an electromagnetic clutch control step of controlling the electromagnetic clutch, wherein the watercraft has a manual maneuvering mode in which the drive unit does not operate the rudder unit and an automatic maneuvering mode in which the drive unit operates the rudder unit, wherein the electromagnetic clutch does not connect the transmission unit and the drive unit during the manual maneuvering mode, and wherein the electromagnetic clutch connects the transmission unit and the drive unit during the automatic maneuvering mode.

17. A non-transitory computer-readable storage medium storing a program for causing a computer provided in a watercraft including a steering unit, a rudder unit, a transmission unit configured to connect the steering unit and the rudder unit and mechanically transmit an input operation on the steering unit to the rudder unit, a drive unit configured to operate the rudder unit without any need for an input operation on the steering unit, and an electromagnetic clutch provided between the transmission unit and the drive unit to execute:

controlling the drive unit; and controlling the electromagnetic clutch, wherein the watercraft has a manual maneuvering mode in which the drive unit does not operate the rudder unit and an automatic maneuvering mode in which the drive unit operates the rudder unit, wherein the electromagnetic clutch does not connect the transmission unit and the drive unit during the manual maneuvering mode, and wherein the electromagnetic clutch connects the transmission unit and the drive unit during the automatic maneuvering mode.

18. A watercraft comprising:

a steering unit;

a rudder unit;

a transmission unit configured to connect the steering unit and the rudder unit and mechanically transmit an input operation on the steering unit to the rudder unit;

a drive unit configured to operate the rudder unit without any need for an input operation on the steering unit, a watercraft control device configured to control the drive unit; and a connection mechanism configured to connect the drive unit and the rudder unit, wherein the connection mechanism includes an electromagnetic clutch, wherein the watercraft has a manual maneuvering mode in which the drive unit does not operate the rudder unit and an automatic maneuvering mode in which the drive unit operates the rudder unit, wherein the electromagnetic clutch does not connect the transmission unit and the drive unit during the manual maneuvering mode, and wherein the electromagnetic clutch connects the transmission unit and the drive unit during the automatic maneuvering mode.

* * * * *